United States Patent [19]

Treadwell

[11] 4,065,068

[45] Dec. 27, 1977

[54] ADDING MACHINE TAPE REVERSING REWINDER

[76] Inventor: John William Treadwell, 8617 Chestnut Oak Road, Baltimore, Md. 21234

[21] Appl. No.: 730,080

[22] Filed: Oct. 6, 1976

[51] Int. Cl.[2] ..... B65H 17/02; B65H 23/26; B41J 29/00

[52] U.S. Cl. ..... 242/67.1 R; 242/75.2; 242/99; 197/180

[58] Field of Search ..... 242/67.1 R, 55, 60, 242/68.4, 68, 96, 99, 85, 67.3 R, 75.2; 197/133 R, 180

[56] References Cited

U.S. PATENT DOCUMENTS

| | | | |
|---|---|---|---|
| 1,533,802 | 4/1925 | Johnson | 242/60 |
| 1,852,517 | 4/1932 | Harrison | 242/99 |
| 1,857,642 | 5/1932 | Jones | 242/67.1 R X |
| 2,896,768 | 7/1959 | Doolittle | 197/133 R |
| 3,033,481 | 5/1962 | Wolk | 242/68.1 X |
| 3,086,739 | 4/1963 | Barber | 242/96 X |
| 3,113,742 | 12/1963 | Bevan et al. | 242/67.1 R |
| 3,447,657 | 6/1969 | Majors | 242/67.1 R X |

FOREIGN PATENT DOCUMENTS

| | | | |
|---|---|---|---|
| 681,070 | 8/1939 | Germany | 242/60 |

*Primary Examiner*—Harvey C. Hornsby
*Assistant Examiner*—John M. Jillions
*Attorney, Agent, or Firm*—John F. McClellan, Sr.

[57] ABSTRACT

An accessory for use with adding machines to receive paper tape and the like from an adding machine as printed-out on one side and to reverse the tape, rewinding its unused-side out ready for re-insertion as a fresh roll in the adding machine so that both sides of the tape can be used, making a 100% saving in the cost and quantity of the paper stock used, at a modest outlay for the device of this invention; a pedestal mounted, slot-held, disassemblable manually-operated reel with co-acting superposed guides has a friction plate for maintaining tape tension and guide plates spaced beneath the guides a distance preventing accidental disassembly.

5 Claims, 3 Drawing Figures

FIG. 1
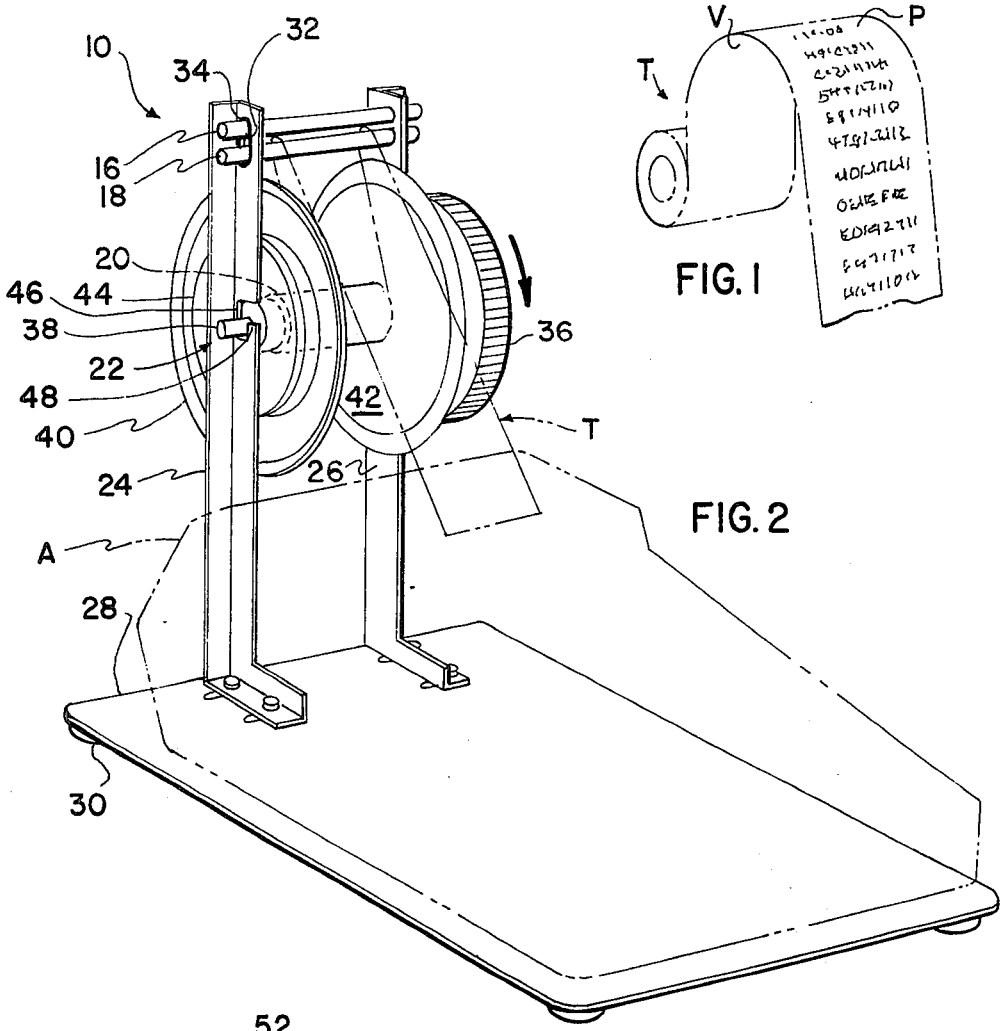
FIG. 2
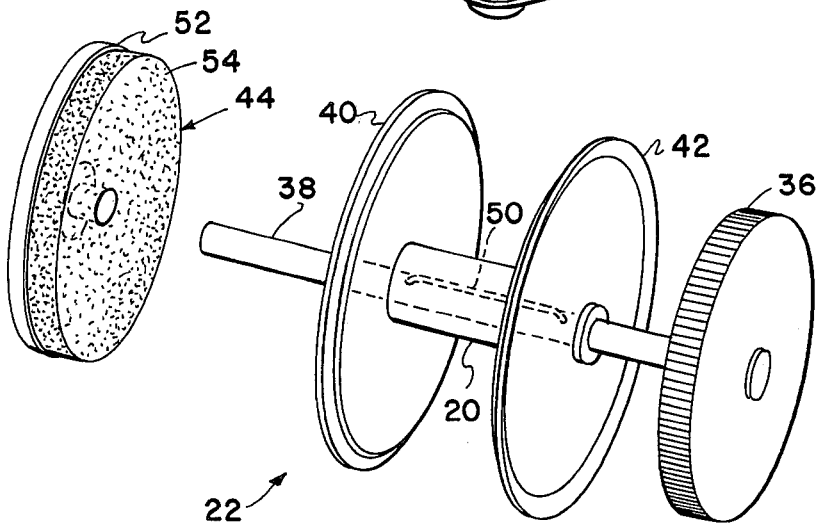
FIG. 3

ADDING MACHINE TAPE REVERSING REWINDER

This invention relates generally to print-out adding machines and the like, and particularly to tape handling systems for same.

A principal object of this invention is to provide a tape handling accessory for receiving tape, as used, from an adding machine and reversing and rewinding the tape unused-side out, ready for reinsertion and reuse in the adding machine so that both surfaces of the tape are economically utilized.

Other objects are to provide a device as described which can be assembled and disassembled rapidly and easily, without the use of tools and without special training, which guards against accidental disassembly, which is to a considerable extent self-adjusting, which is economical to make, purchase and use, which is durable, compact, convenient and is attractive in appearance.

In brief summary of a preferred embodiment given for cursive-description purposes only, the invention includes a knob-driven spindle assembly for friction driving a tape roll, an axially acting friction plate, guide plates on the spindle at the sides of the roll, a pedestal detachably holding the spindle by means of recesses, a removable tape guide on the pedestal in position to prevent accidental detachment of the spindle assembly from the pedestal recesses, and a pedestal base extending in a direction transverse to the spindle for receiving an adding machine or the like.

The above and other advantages and objects of the invention will become more readily apparent on examination of the following description, including the drawing in which like reference numerals indicate like parts:

FIG. 1 is a fragmentary detail of a roll of adding machine tape or the like, oriented generally as in the second Figure;

FIG. 2 is an isometric view of the invention in use with an adding machine (phantom lines); and FIG. 3 is a partial-assembly detail of the spindle assembly of the invention.

FIG. 1 shows the desired end result produced by the invention; a roll of used adding machine tape T or the like re-rolled with the printed side P in and the unprinted side U out, ready for reinsertion in an adding machine and re-use.

FIG. 2 shows an adding machine A or other machine of the type which prints-out on a roll of tape T. As shown, the tape may emerge from the rear of the adding machine, but it may equally well emerge from the side.

The invention 10 receives the tape between horizontal guide structure in the form of a pair of leveler bars 16, 18, which clear and guide the tape run, and reverses and re-reels the tape on a roll 20 mounted on a spindle assembly 22. The roll is chosen to be the proper size to fit the adding machine so that the tape can be reinserted in the adding machine after reversal.

A pedestal assembly including a pair of uprights 24, 26, adjustably mounted by screws on a base 28 holds the leveler bars and spindle assembly in parallel-spaced relation. Extra holes are provided for gross lateral adjustment. The base has a non-marring resilient pad 30 at each corner and a planar top surface on which the adding machine rests, stabilizing the invention and the adding machine as an adjustable unit.

The leveler bars are loosely mounted in holes 32 in the uprights above the spindle assembly and detachably secured by rubber "O" rings 34 snapped around the paired protruding ends of the leveler bars at each upright. The tape T passes from front to back through the leveler bars and then downward and around the front of the spindle assembly which is rotated manually through a knob 36 and the spindle axle 38 counter clockwise direction (arrow) when required to take up slack.

The detachable tubular roll 20 on the spindle assembly stores the tape as rolled and may be initially attached to the tape by a small piece of masking tape or the like. Disk-shaped side plates 40, 42 freely mounted on the spindle axle assure alignment of the adding machine tape on the roll, and a friction plate 44, described later, adjustably maintains fit of the side plates to the roll and retards the tape from feeding off the roll.

Upward opening slots 46 in the uprights loosely receive and hold the spindle axle, which can be lifted over the lower lip or threshold 48 of the slots for disassembly from the uprights.

Accidental spindle-disassembly is prevented by the following relations of the parts. The spacing between the slot threshold 48 and the lower leveler bar 18 is made less than the combined side plate radius and axle radius, so that the side plate circumference strikes the lower leveler bar when lifted, unless the leveler bar is removed to permit spindle assembly removal.

FIG. 3 shows relations of the parts of the spindle assembly partially assembled.

Knob 36 is fixed to spindle axle 38. The side plates 40, 42 and friction plate 44 slide freely on the spindle axle. The roll 20 also slides on the spindle axle, somewhat retarded by a spring 50 mounted at the ends in axially spaced holes in the axle and bowing outward from the axle for frictional engagement with the bore of the roll. Any equivalent frictional means may be used for the purpose, which is to afford frictional drive of the roll on rotation of the knob to take up slack in the tape, and to maintain assembly by retarding axial motion of the spindle axle relative to the remainder of the spindle assembly, but to permit disassembly of the spindle assembly in order to remove the roll.

The friction plate 44 includes an outer shell 52 journaled to rotate freely on the axle. To the outer shell is cemented a relatively thick friction disk 54 of low-density resilient foam, such as polyurethane foam or the equivalent.

In operation, the friction plate serves two purposes as previously noted. It exerts a resilient axial force between the proximate upright and side plate, causing the parts mounted on the spindle axle to engage the uprights at the ends:

1. providing frictional drag on the spindle assembly to prevent unreeling of paper being reeled onto it, and
2. accommodating various roll lengths without adjustment. As result, the tape being reversed can be stripped out at any time for inspection and rewound without necessity of adjusting a ratchet, the force reeling the tape is limited to a set maximum, preventing breaking the tape. The spindle assembly can be instantly dismounted, disassembled, reassembled, left handed or right handed as desired, and remounted without necessity to operate set screws, or to break and make adjustments when changing adding machines. The assembly is economical to construct, and in fact can be made of plastic, is durable, simple, reliable, and lightweight, the uprights being angled with inner parallel-spaced flanges, simplifying frictional engagement.

As an added benefit of the invention, a longer strip of the tape is in sight at all times than would be available in other arrangements.

Obviously many modifications and variations of the present invention are possible in light of the above teachings. It is, therefore, to be understood that within the scope of the appended claims the invention may be practiced otherwise than as specifically described.

What is claimed and desired to be secured by U.S. Letters Patent is:

1. A reversing rewinder for use with adding machines or the like employing tapes, comprising: horizontal guide means comprising a pair of leveller bars, a spindle assembly having a detachable roll for rewinding and storing tape, the spindle assembly including an axle with the roll slidably mounted thereon and a side plate slidably mounted on the axle at each end of the roll, means for frictionally braking said spindle assembly, a pedestal having upright means for detachably holding the leveller bars and the spindle assembly in parallel spaced relation below the leveller bars, the upright means including a pair of laterally spaced uprights with means defining in each upright a respective aperture, the apertures proportioned for holding the ends of the leveller bars, means defining in each upright a lateral slot with a lip at the lower outboard portion thereof for holding the ends of the axle of the spindle; a base extending forwardly from the pedestal for receiving said an adding machine with a tape having a first side and a reverse side, with the tape first side upward and the tape extending rearwardly and upwardly from said an adding machine through the horizontal guide structure and then downwardly and around the front of the spindle assembly; a knob for rotating the spindle assembly and storing the tape upon the roll with the reverse side of the tape outward, and the reversing rewinder being provided with means for preventing accidental detachment of the spindle assembly in that the side plates are circular and the combined dimension of a side plate radius and the radius of the axle of the spindle exceeds the dimension from the slot lip to the leveller bars and prevents spindle disengagement from said upwardly opening slots.

2. A reversing rewinder as recited in claim 1, wherein the means for frictionally braking the spindle assembly includes a friction plate disposed for exerting a resilient axial force causing portions of the spindle assembly to contact the uprights and retard spindle rotation.

3. A reversing rewinder as recited in claim 2, wherein the friction plate is disposed between one said side plate and one said upright.

4. A reversing rewinder as recited in claim 1 wherein the spindle assembly includes means for resiliently engaging the bore of the roll.

5. A reversing rewinder as recited in claim 1 wherein the respective ends of the pair of leveller bars protrude through the uprights, and means for for retaining the pair of leveller bars in the uprights, including a resilient circular member encircling at least one of the respective ends protruding through the uprights.

* * * * *